US009857046B2

(12) United States Patent
Abe

(10) Patent No.: US 9,857,046 B2
(45) Date of Patent: Jan. 2, 2018

(54) LAMP FOR VEHICLES

(71) Applicant: ICHIKOH INDUSTRIES, LTD., Isehara-shi, Kanagawa-ken (JP)

(72) Inventor: Toshiya Abe, Isehara (JP)

(73) Assignee: ICHIKOH INDUSTRIES, LTD., Isehara-Shi (JP)

( * ) Notice: Subject to any disclaimer, the term of this patent is extended or adjusted under 35 U.S.C. 154(b) by 0 days.

(21) Appl. No.: 14/891,497

(22) PCT Filed: May 16, 2014

(86) PCT No.: PCT/JP2014/063046
§ 371 (c)(1),
(2) Date: Nov. 16, 2015

(87) PCT Pub. No.: WO2014/185512
PCT Pub. Date: Nov. 20, 2014

(65) Prior Publication Data

US 2016/0084470 A1 Mar. 24, 2016

(30) Foreign Application Priority Data

May 17, 2013 (JP) ..... 2013-105405
Aug. 20, 2013 (JP) ..... 2013-170574

(51) Int. Cl.
*F21S 8/10* (2006.01)

(52) U.S. Cl.
CPC ..... *F21S 48/31* (2013.01); *F21S 48/1154* (2013.01); *F21S 48/1216* (2013.01); *F21S 48/1258* (2013.01); *F21S 48/321* (2013.01); *F21S 48/328* (2013.01)

(58) Field of Classification Search
CPC .... F21S 48/31; F21S 48/1154; F21S 48/1216; F21S 48/321; F21S 48/328; F21S 48/1258
See application file for complete search history.

(56) References Cited

U.S. PATENT DOCUMENTS

| | | | | |
|---|---|---|---|---|
| 1,334,762 | A | 3/1920 | Kuen | |
| 6,382,818 | B1 | 5/2002 | Iwama et al. | |
| 2006/0013000 | A1 | 1/2006 | Coushaine et al. | |
| 2010/0321947 | A1 | 12/2010 | Hamashima | |
| 2012/0236563 | A1 * | 9/2012 | Breidenassel | F21V 17/12 362/249.02 |

FOREIGN PATENT DOCUMENTS

| | | | |
|---|---|---|---|
| JP | 2006-032348 | A | 2/2006 |
| JP | 2010-040315 | A | 2/2010 |
| JP | 2012-119260 | A | 6/2012 |
| JP | 2013-513197 | A | 4/2013 |
| JP | 2013-082354 | A | 5/2013 |
| WO | WO-2012/007902 | A1 | 1/2012 |

* cited by examiner

*Primary Examiner* — David V Bruce
(74) *Attorney, Agent, or Firm* — Foley & Lardner LLP

(57) ABSTRACT

In a conventional lamp for vehicles, there may be a case in which any shuddering is generated. The present invention comprises a semiconductor-type light source, a lens, a lens holder, and a heat sink member. An attachment hook section is provided in the lens holder. Attachment sections are provided in the heat sink member. The attachment sections of the heat sink member are interposed between the lens holder and the attachment hook section. The present invention is capable of attaching the lens holder to the heat sink member without any shuddering being generated.

8 Claims, 14 Drawing Sheets

LAMP FOR VEHICLES

TECHNICAL FIELD

The present invention relates to a lamp for vehicles. In particular, the present invention relates to a lamp for vehicles, which is capable of reliably attaching an attached member such as a lens holder or a reflector to an attachment member such as a heat sink member without using a screw or the like.

BACKGROUND ART

Conventionally, a lamp for vehicles of this type is conventionally known (for example, Patent Literature 1). Hereinafter, a conventional lamp for vehicles will be described. The conventional lamp for vehicles forms an engagingly locking protrusion at a lens holder; forms an engagingly locking hole in a heat sink; and engagingly locks the engagingly locking protrusion with the engagingly locking hole in one direction to thereby attach the lens holder to the heat sink.

CITATION LIST

Patent Literature

Patent Literature 1: Japanese Unexamined Patent Application Publication No. 2012-119260

SUMMARY OF THE INVENTION

Problems to be Solved by the Invention

However, the conventional lamp for vehicles engagingly locks the engagingly locking protrusion with the engagingly locking hole in one direction and thus there may be a case in which any shuddering is generated in an opposite direction to one direction in which the engagingly locking protrusion and the engagingly locking hole engage with each other.

A problem to be solved by the present invention is that, in the conventional lamp for vehicles, there may be a case in which any shuddering is generated.

Means for Solving the Problem

A lamp for vehicles according to first aspect of the invention, comprising: a light source; an attachment member; and an attached member, wherein at the attachment member and the attached member, attachment structures to attach the attached member to the attachment member are respectively provided, the attachment structures each are composed of: an attachment section which is provided at least at either one of the attachment member and the attached member, and which has an insertion space section; and an attachment hook section which is provided at least at another one of the attachment member and the attached member, and which is inserted into the insertion space section and then is moved in a direction crossing the insertion direction to thereby interpose the attachment section between the attachment hook section and at least said another one of the attachment member and the attached member and then attach the attached member to the attachment member.

The lamp for vehicles according to second aspect of the invention, wherein the attachment hook section is composed of: an interposing section which is provided to oppose to at least at said another one of the attachment member and the attached member, and which interposes the attachment section; and a positioning section which is provided in the movement direction between at least said another one of the attachment member and the attached member and the interposing section, and which abuts against an edge at the movement direction side of the insertion space section and then determines a position in the movement direction.

The lamp for vehicles according to third aspect of the invention, wherein, at said another one of the attachment member and the attached member, in a state in which the positioning section abuts against the edge at the movement direction side of the insertion space section, there is provided a slip stop section to abut against an opposite edge to the edge at the movement direction side and then determine an opposite position to the movement direction and then stop the attachment hook section from slipping off from the attachment section.

The lamp for vehicles, according to fourth aspect of the invention, wherein the positioning section and the edge at the movement direction side of the insertion space section against which the positioning section abuts are provided at least by two in a direction crossing the insertion direction and the movement direction.

The lamp for vehicles according to fifth aspect of the invention, wherein the movement direction is a direction crossing a gravitational direction.

A lamp for vehicles according to sixth aspect of the present invention, comprising: an attachment member to which a light source is attached; an attached member; and an attachment structure to attach the attached member to the attachment member, wherein the attachment structure is composed of: an attachment section which is provided at least at either one of the attachment member and the attached member, and which has an insertion space section; and an attachment hook section which is provided at least at another one of the attachment member and the attached member and which is inserted into the insertion space section, and which is moved in a direction crossing the insertion direction to thereby interpose the attachment section between the attachment hook section and at least said another one of the attachment member and the attached member and then attach the attached member to the attachment member, wherein the attachment structure is provided in plurality, wherein, in a front view, the light source is positioned inside of a plurality of the attachment structures, and wherein, in a front view, distances between the respective attachment structures and the light source are substantially equal to each other.

The lamp for vehicles, according to seventh aspect of the invention, wherein the attachment hook section is provided at least by one in a direction crossing the movement direction, and is composed of: a rising plate section which is provided to rise in the insertion direction from at least another one of the attachment member and the attached member; an interposing plate section which is extended from the rising plate section in the movement direction, and which interposes the attachment section between the interposing plate and at least said another one of the attachment member and the attached member; and a reinforcement plate section which is provided at one side of a respective one of the rising plate section and the interposing plate section, said one side being at a symmetrical position with respect to the movement direction.

Effect of the Invention

In so far as the lamp for vehicles, of the present invention, is concerned, an attachment portion of at least either one of an attachment member and an attached member is interposed from both sides between another one of the attachment member and the attachment member (hereinafter, merely referred to as "another one of the attachment member and the attached member") and an attachment hook section, and the attached member is attached to the attachment member. Thus, any shuddering in an opposite direction to a direction in which the attachment section and another one of the attachment member and the attached member abut against each other can be eliminated by way of a mutual abutment between the attachment section and an attachment hook section. On the other hand, any shuddering which is generated in the opposite direction to the direction in which the attachment section and the attachment hook section abut against each other can be eliminated by way of a mutual abutment between the attachment section and the another one of the attachment member and the attached member. Thus, the attached member can be reliably attached to the attachment member without using a screw or the like.

MODE FOR CARRYING OUT THE INVENTION

An embodiment (example) and a modification example of a lamp for vehicles, according to the present invention, will be described with reference to the drawings. It is to be noted that the present invention is limited by the embodiment. In the specification, the front, rear, top, bottom, left, and right are respectively equivalent to the front, rear, top, bottom, left, and right when the lamp for vehicles, according to the present invention, is mounted on a vehicle.

Configuration of Embodiment

Figure 1:
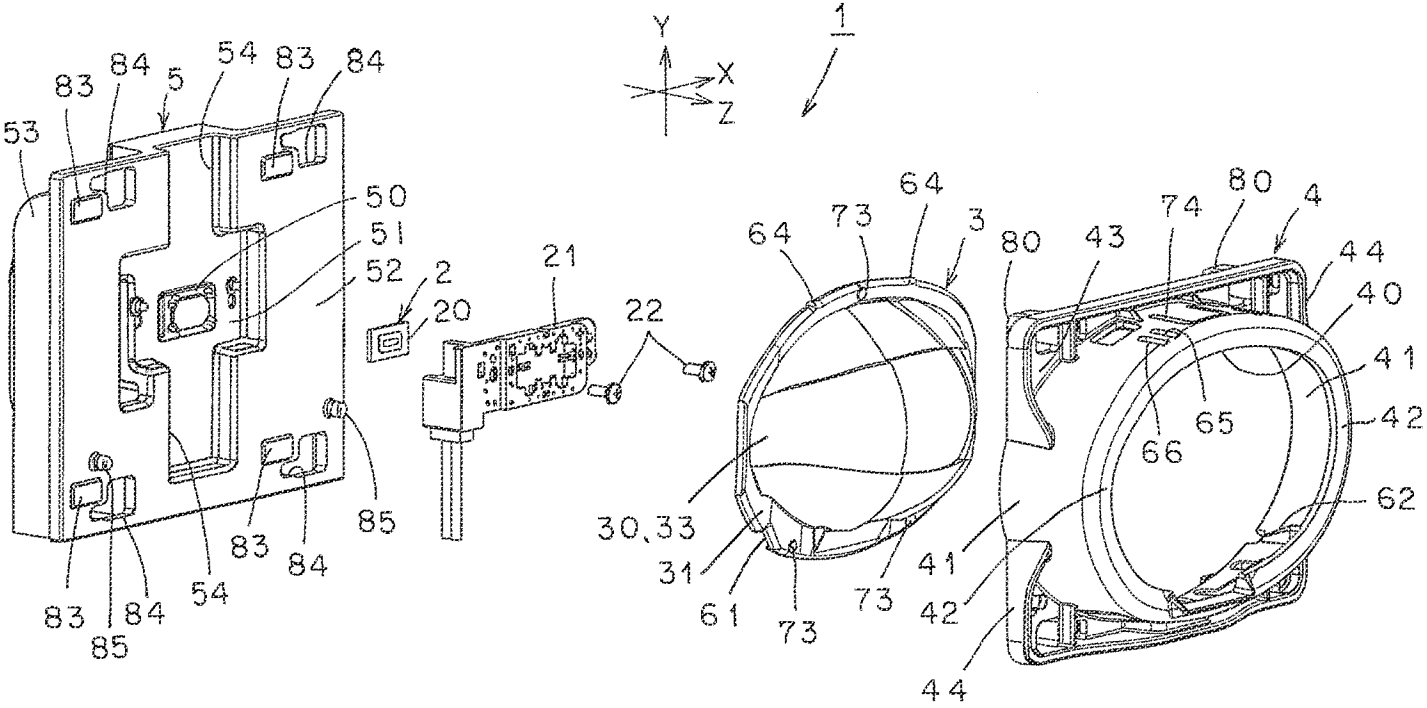
FIG. 1 is a perspective view seen from a front (surface, front) side oblique top of an exploded state of a lamp unit showing an embodiment of a lamp for vehicles, according to the present invention.

FIG. 1 to FIG. 17 each show an embodiment of a lamp for vehicles, according to the present invention. Hereinafter, a configuration of the lamp for vehicles, according to the embodiment, will be described. In FIG. 1, reference numeral 1 designates a lamp for vehicles, according to the embodiment (for example, a headlamp for vehicles such as a headlamp). The lamp 1 for vehicles is mounted at each of the left and right end parts of a front part of a vehicle.

(Lamp 1 for Vehicles)

The lamp 1 for vehicles, as shown in FIG. 1, is provided with: a lamp housing (not shown); a lamp lens (not shown), a semiconductor-type light source 2 as a light source; a lens 3; a lens holder 4; and an attachment member compatible with a heat sink member (hereinafter, referred to as a "heat sink member") 5. The semiconductor-type light source 2 is attached to the heat sink member 5 as a mounting member. The lens 3 and the lens holder 4 are attached members to be attached to the heat sink member 5 as an attachment member.

(Lamp Unit 2, 3, 4, 5)

The semiconductor-type light source 2, the lens 3, the lens holder 4, and the heat sink member 5 constitute a lamp unit. The lamp housing and the lamp lens partition a lamp room (not shown). The lamp unit formed by the constituent elements 2, 3, 4, 5 is disposed in the lamp room, and is attached to the lamp housing via an optical axis adjustment mechanism for vertical direction (not shown) and an optical axis adjustment mechanism for transverse direction (not shown).

(Semiconductor-Type Light Source 2)

The semiconductor-type light source 2, as shown in FIG. 1, in this example, is a self-emission semiconductor-type light source such as an LED, an OEL (an organic EL), or an OLED (an organic LED), for example. The semiconductor-type light source 2 is composed of: a light emitting chip (an LED chip) having a light emission surface; a package (an LED package), sealing the light emitting chip with a sealing resin member therein; and a board 20 implementing the package thereon. The semiconductor-type light source 2 is positioned and attached to a light source mounting section 50 of the heat sink member 5 via a light source holder 21.

The light emission surface of the light emitting chip is oriented to a front side of a reference optical axis (a reference axis) Z of the lens 3. A center of the light emission surface of the light emitting chip is positioned at or near a reference focal point of the lens 3, and is positioned on or near the reference optical axis Z of the lens 3.

In FIG. 1, axes X, Y, Z constitute an orthogonal coordinate (an X-Y-Z orthogonal coordinate system). The X-axis is a horizontal axis in a transverse direction passing through the center of the light emission surface of the light emitting chip, and in the embodiment, the outside of a vehicle, that is, the left side is in a positive direction (in the X-axis direction), and the right side is in a negative direction (an opposite direction to the X-axis direction). In addition, the Y-axis is a vertical axis in a vertical direction passing through the center of the light emission surface of the light emitting chip, and in the embodiment, the upper side is in a positive direction (the Y-axis direction), and the lower side is in a negative direction (an opposite direction to the Y-axis direction). Further, the Z-axis is a normal line (a perpendicular line) passing through the center of the light emission surface of the light emitting chip, that is, is an axis in a longitudinal direction which is orthogonal to the X-axis and the Y-axis, and in the embodiment, the front side is in a positive direction (the Z-axis direction), and the rear side is in a negative direction (an opposite direction to the Z-axis direction). The reference optical axis Z of the lens 3 and the Z-axis are coincident with or is substantially coincident with each other.

The light source holder 21 is positioned and attached to a light source holder attachment section 51 of the heat sink member 5 by way of a screw 22. In the light source holder 21, a holder section to hold the semiconductor-type light source 2 at the heat sink member 5; and a terminal, a circuit, and a connector to supply power to the semiconductor-type light source 2 are respectively provided at their appropriate positions.

(Lens 3)

The lens 3, as shown in FIG. 1 to FIG. 4, FIG. 6, and FIG. 7, is composed of a lens section 30, an auxiliary lens section (an additional lens section), and a flange section 31. A shape in a front view of the lens section 30 forms a noncircular shape. That is, the lens 3 is a uniquely shaped lens. The lens 3 is composed of a resin member.

In so far as the shape of the lens 3 is concerned, a thickness on or near the reference optical axis X is the largest, and its thickness becomes smaller as it is spaced from the reference optical axis Z. Thus, a gravity of the lens 3 is positioned on or near the reference optical axis X.

The lens 3 is positioned and retained at the lens holder 4. The lens 3 is positioned and attached to the heat sink member 5 via the lens holder 4. The lens 3 transmits light from the semiconductor-type light source 2 through transmit the lens section 30 and then the transmitted light is emitted to the outside.

The lens section 30 is composed of: an incidence surface 32 at a rear side of the lens 3; and an emission surface 33 at a front side of the lens 3. The incidence surface 32 forms a convex curved face which protrudes to the semiconductor-type light source 2 side, a concaved curved face which is recessed to an opposite side to the semiconductor-type light source 2, a face formed of a combination thereof, or a plane. The incidence surface 32 is composed of: a free curved face; a quadratic curved face, a composite quadratic curved face, or a face made of a combination thereof; or a plane. The emission surface 33 forms a convex curved face that protrudes to an opposite side to the semiconductor-type light source 2. The emission surface 33 is composed of a free curved face, a quadratic curved face, a composite quadratic curved face, or a face formed of a combination thereof.

The auxiliary lens section is integrally provided at a lower center part of a peripheral edge part of the lens section 30. The auxiliary lens section is composed of an incidence surface, a reflection surface, and an emission surface.

The flange section 31 is integrally provided at (all or part) of a peripheral edge part of a respective one of the lens section 30 and the auxiliary lens section. A rear face of the flange section 31 is made of a free curved face or a plane that is substantially similar to the incidence surface 32. A front face of the flange section 31 is made of a free curved face that is substantially similar to the emission surface 33. A shape in a front view of an edge (an end face or an exterior face) of the flange section 31 forms a noncircular shape like the shape in the front view of the lens section 30.

(Lens Holder 4)

The lens holder 4 is composed of a resin member having elasticity and a lower thermal conductivity thereof than that of the heat sink member 5 (having a large thermal resistance), for example, a resin member. The lens holder 4, as shown in FIG. 1, FIG. 2, and FIG. 5 to FIG. 7, is composed of a cylindrical structure having an opening section 40 in which the lens section 30 is to be disposed at a center part. The lens holder 4 is composed of a holding cylindrical section 41, a holding edge part 42, a mounting plate section 43, and a reinforcement rib section 44.

The lens holder 4 positions and holds the lens 3. The lens holder 4 is positioned and attached to the heat sink member 5. As a result, the lens 3 is positioned and attached to the heat sink member 5 via the lens holder 4.

The holding cylindrical section 41 forms a cylindrical shape. A shape in a front view of the holding cylindrical section 41 forms a noncircular shape like the shape in the front view of the lens 3. An inner circumferential face of the holding cylindrical section 41 forms a shape that is slightly larger than an outer circumferential face of an edge of the flange section 31 of the lens 3.

The holding edge part 42 forms a flange shape, and is integrally provided inside of the holding cylindrical section 41 from one end (a front side edge) of the holding cylindrical section 41. At a center part of the holding edge part 42, the opening section 40 is provided. A shape in a front view of the inner circumferential face of the holding edge part 42 (that is, an edge of the opening section 40) forms a noncircular shape like the shape in the front view of the lens section 30 of the lens 3. The inner circumferential face of the holding edge part 42 forms a shape which is slightly smaller than the outer circumferential face of the edge of the flange section 31 of the lens 3 and which is slightly larger than a boundary between the lens section 30 and the flange section 31.

The mounting plate section 43 forms a shape of a plate, and is integrally provided upper outside and lower outside of the holding cylindrical section 41 from an upper part and a lower part of another end (an edge of a rear side) of the holding cylindrical section 41. A shape in a front view of an external shape of the mounting plate section 43 forms a substantial rectangular shape. That is, an intermediate part of both of the left and right edges of the mounting plate section 43 is a part of both of the left and right side parts of the holding cylindrical section 41, and forms a curved shape.

The reinforcement rib section 44 forms a rib shape, and is integrally provided at a front side from four edges of the mounting plate section 43. A shape in a front view of the reinforcement rib section 44 forms a substantially rectangular shape that is substantially similar to the shape in the front view of the external shape of the mounting plate section 43. That is, the reinforcement rib section 44 of an upper side forms a U-shape of which lower side opens, and the reinforcement rib section 44 of a lower side forms a U-shape of which an upper side opens.

(Heat Sink Member 5)

The heat sink member 5 is a mounting member to which the semiconductor-type light source 2 and the lens holder 4 are mounted and to which the lens 3 is mounted via the lens holder 4. The heat sink member 5 radiates, to the outside, a heat that is generated at the semiconductor-type light source 2. The heat sink member 5 is made of an aluminum die-cast or a resin member having thermal conductivity, for example. The heat sink member 5, as shown in FIG. 1, is composed of: a vertical plate section 52; and a plurality of vertically plate-shaped fin sections 53 which are integrally provided on one face (a rear face) of the vertical plate section 52.

At a center part of a mounting surface (a plane or a substantial plane) of another face (a front face) of the vertical plate section 52 of the heat sink member 5, a substantially cross-shaped recessed part 54 is provided. At a center part of a bottom face of the recessed part 54, the light source mounting section 50 is provided. On the bottom face of the recessed part 54 and at the periphery of the light source mounting section 50, the light source holder attachment section 51 is provided.

(Positioning Section)

At the lens 3 and the lens holder 4, positioning sections are respectively provided. The positioning sections each determine a position of the lens 3 with respect to the lens holder 4. The positioning sections each are composed of an XY-positioning section, a rotation positioning section, and a Z-positioning section.

(XY-Positioning Section)

Figure 2:
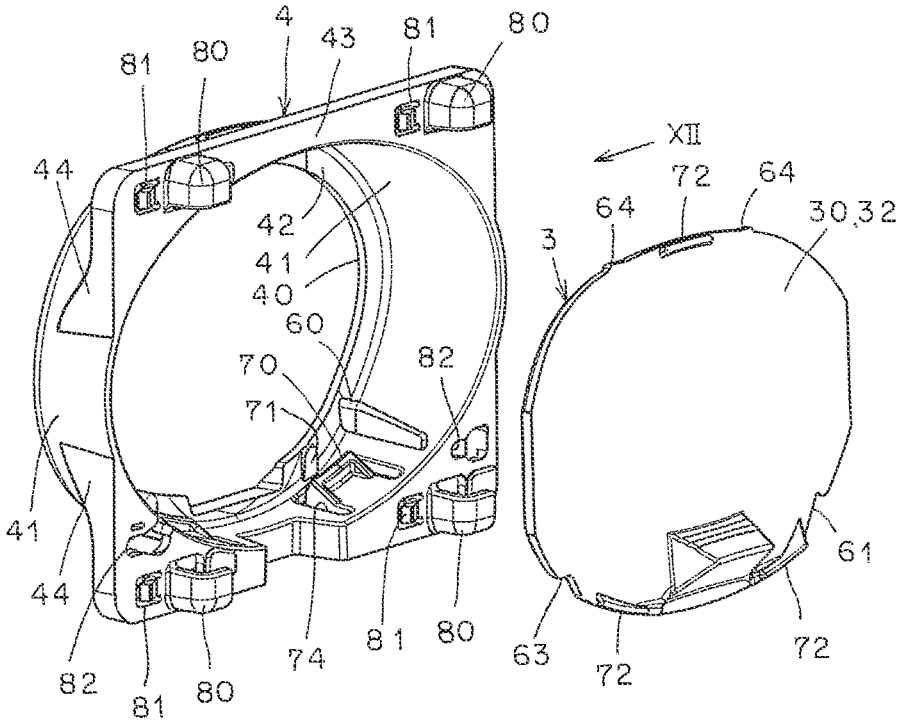
FIG. 2 is an exploded perspective view seen from a rear (back, rear) side oblique top showing a lens and a lens holder of the lamp unit.
Figure 7:
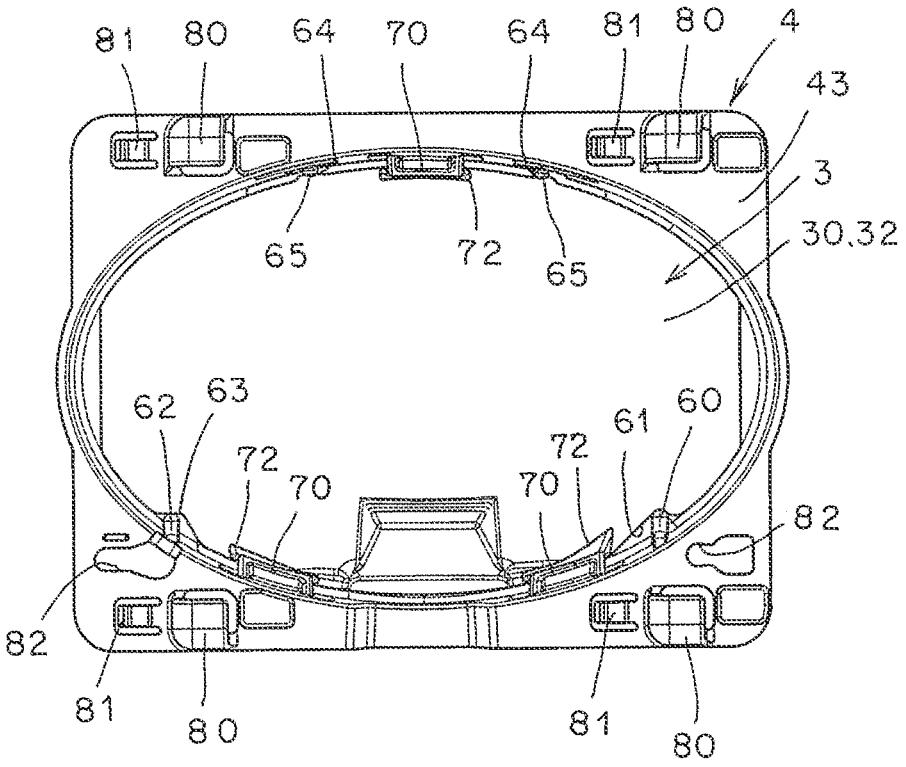
FIG. 7 is a rear view showing the assembled state between the lens and the lens holder of the lamp unit.
Figure 8:
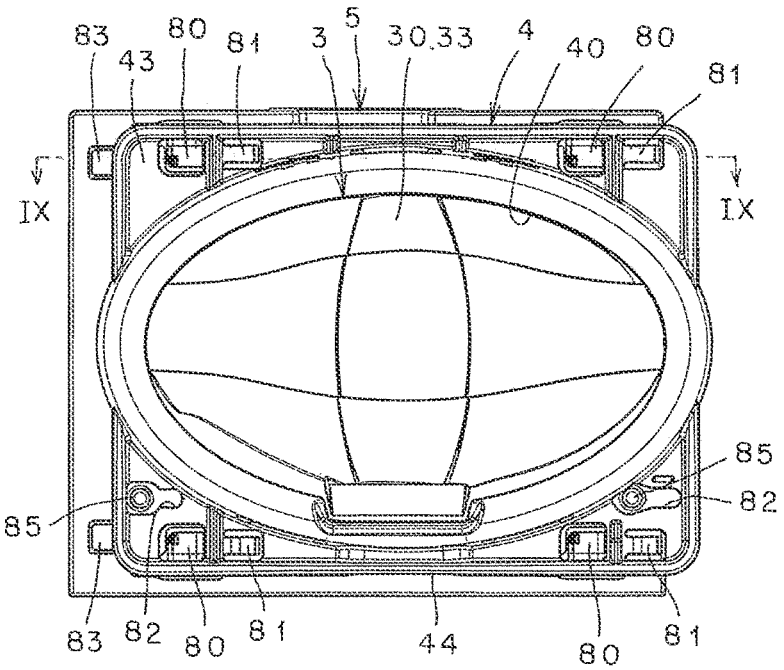
FIG. 8 is a front view showing a state before the lens and the lens holder are attached to a heat sink member.

The XY-positioning section determines positions of the X-axis direction and the Y-axis direction of the lens 3. The XY-positioning section, as shown in FIG. 2 and FIG. 7, is composed of a protrusion section 60 that protrudes in the Y-axis direction and the Z-axis direction; and a contact surface 61 that comes into contact with two parts (two points or two straight lines) of a side face of the protrusion section 60.

The protrusion section 60 of the XY-positioning section is provided at a part of the lower right side of the inner circumferential face of the holding cylindrical section 41 of the lens holder 4. It is sufficient if the protrusion section 60 of the XY-positioning section is partially composed of a curved face part at which the contact surface 61 comes into contact with the two parts or the straight line. For example, this protrusion section may be a pin. The contact surface 61 of the XY-positioning section is provided to correspond to the protrusion section 60 at the part of the lower right side of the flange section 31 of the lens 3. The contact surface 61 of the XY-positioning section is made of two V-planes or one curved face.

(Rotation Positioning Section)

The rotation positioning section determines a position in a rotation direction on an XY-plane about the XY-positioning section of the lens 3 (about the curved face part of the protrusion section 60). The rotation positioning section, as shown in FIG. 7, is composed of: a protrusion section 62 which protrudes in the Y-axis direction and the Z-axis direction; and a contact surface 63 which comes into contact with one part of an upper part of the protrusion section 62 (one part or one straight line).

The protrusion section 62 of the rotation positioning section is provided at a part of the lower right side of the inner circumferential face of the holding cylindrical section 41 of the lens holder 4. It is sufficient if the protrusion section 62 of the rotation positioning section is partially composed of a curved face part at which the contact surface 63 comes into contact with one point or comes into contact the straight line. For example, this protrusion section may be a pin. The contact surface 63 of the rotation positioning section is provided to correspond to the protrusion section 62 at a part of the lower left side of the flange section 31 of the lens 3. The contact surface 63 of the rotation positioning section forms a plane or a curved face.

(Z-Positioning Section)

The Z-positioning section determines a position in the Z-axis direction of the lens 3 (in the Z-axis direction of the reference optical axis). The Z-positioning section of the lens holder 4 is composed of a pressing section 70 and a positioning surface 71. On the other hand, the Z-positioning section of the lens 3 is composed of: a receiving-protrusion section 72 as a receiving section; and a positioning protrusion section 73 as a positioning abutment section.

The pressing section 70 is provided protrusively inside of the lens holder 4 at a respective one of three parts, an upper center and both of lower left and right sides of the holding cylindrical section 41 of the lens holder 4. At the both of the left and right sides and a front side of the pressing section 70 (a boundary between the holding cylindrical section 41 and the holding edge part 42), recess-shaped cutouts 74 are provided. As a result, the pressing section 70 has elasticity thereof in a perpendicular direction or in a substantially perpendicular direction with respect to the Z-axis direction of the reference optical axis of the lens 3 (the Z-axis direction). The pressing section 70 presses the lens 3 in the Z-axis direction.

The positioning surface 71 is provided to oppose to the pressing section 70 on a respective one of the interior faces (rear faces) of three parts, an upper center and both of lower left and right sides of the holding edge part 42 of the lens holder 4. The positioning surface 71 is a surface that is orthogonal to or substantially orthogonal to the Z-axis direction of the reference optical axis of the lens 3.

The positioning protrusion section 73 is provided to correspond to a surface which opposes to the positioning surface 71, of the flange section 31 of the lens 3, and to correspond to the positioning surface 71, at a respective one of the upper center and both of the lower left and right sides of the flange section 31. The positioning protrusion section 73 forms a minute conical trapezoidal shape. That is, an apex of the positioning protrusion section 73 is made of a minute plane that is perpendicular to or substantially perpendicular to the reference optical axis Z. As a result, the positioning protrusion section 73 abuts against the positioning surface 71 on the minute plane due to a pressing force of the pressing section 70 that is received on the receiving-protrusion section 72. It is to be noted that a shape of the positioning protrusion section 73 may be a shape other than the conical trapezoidal shape, for example, a columnar shape, or alternatively, may form a hemispheric shape and abut against the positioning surface 71 at a point.

The receiving-protrusion section 72 is provided to correspond to a surface which opposes to the pressing section 70 of the flange section 31 of the lens 3 and the pressing section 70 at a respective one of the three parts, the upper center and both of the lower left and right sides of the flange section 31. The receiving-protrusion section 72 forms a protrusion stripe shape along an edge of the flange section 31. An exterior face of the receiving-protrusion section 72 forms a curved face. As a result, the receiving-protrusion section 72 receives the pressing force of the pressing section 70 in a linear shape or in a substantially linear shape along the edge of the flange section 31.

Lower two of the three pressing section 70, the positioning surface 71, the receiving-protrusion section 72, and the positioning protrusion section 73 of the Z-positioning section are respectively positioned between the protrusion section 60 and the contact surface 61 of the XY-positioning section and between the protrusion section 62 and the contact surface 63 of the rotation positioning section. The three pressing section 70, the positioning surface 71, the receiving-protrusion section 72, and the positioning protrusion section 73 of the Z-positioning section are respectively disposed at positions which surround a gravity of the lens 3.

(Gap Narrowing Section)

At the lens 3 and the lens holder 4, gap narrowing sections are respectively provided. The gap narrowing sections narrow a gap between the protrusion section 60 and the contact surface 61 of the XY-positioning section and a gap between the protrusion section 62 and the contact surface 63 of the rotation positioning section. That is, the gap narrowing sections position the lens 3 reliably without any shuddering being generated, at a position which is determined by the XY-positioning section (the position in the X-axis direction and the Y-axis direction) and a position which is determined by the rotation positioning section (the position in the rotation direction on the XY-plane).

Figure 3:
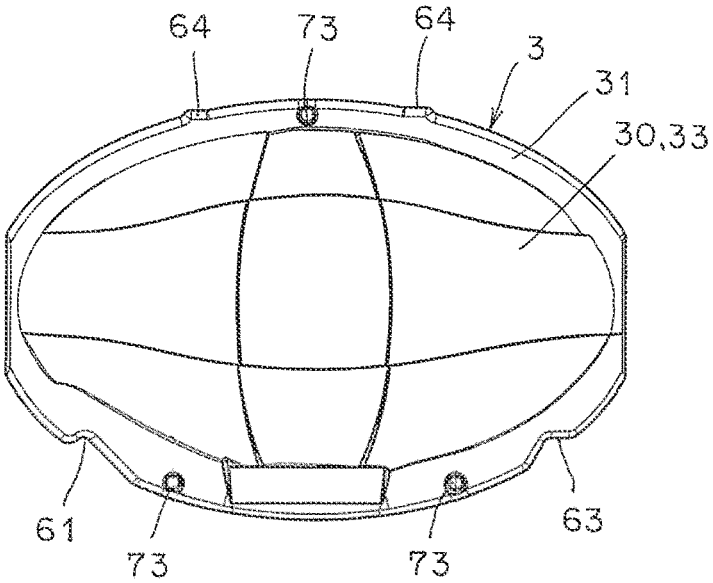
FIG. 3 is a front view showing the lens of the lamp unit.
Figure 4:
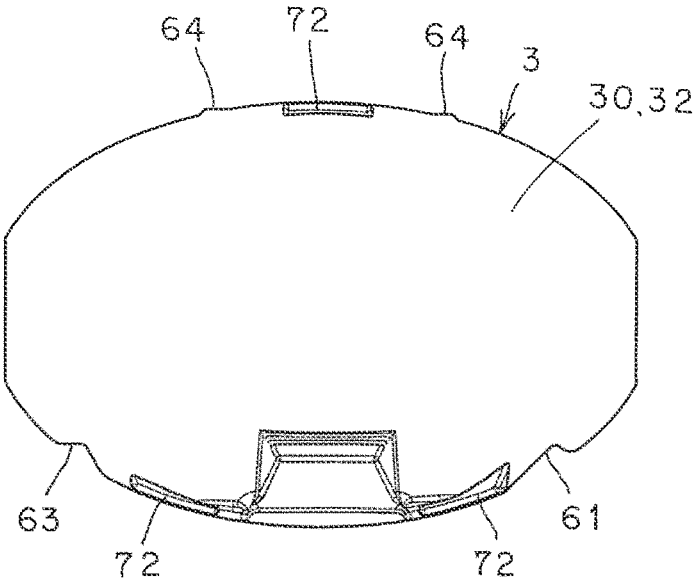
FIG. 4 is a rear view showing the lens of the lamp unit.

The gap narrowing section of the lens 3, as shown in FIG. 2 to FIG. 4, is composed of a receiving surface 64. The receiving surface 64 is provided at a respective one of two parts at both of the upper left and right sides of an edge (an edge face) of the flange section 31 of the lens 3. The two receiving surfaces 64 are respectively made of planes which are parallel to or substantially parallel to each other with respect to the X-axis. The two receiving surfaces 64 are disposed at both of the left and right sides of the receiving-protrusion section 72 and the positioning protrusion section 73 of the Z-positioning section of the top lens 3.

Figure 5:
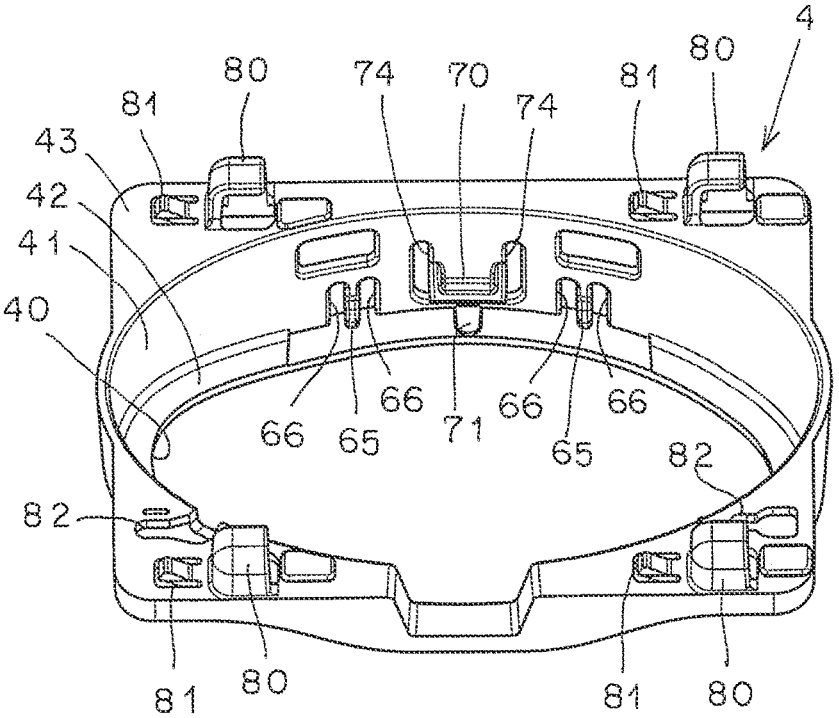
FIG. 5 is a perspective view seen from a rear side bottom showing a lens holder of the lamp unit.
Figure 6:
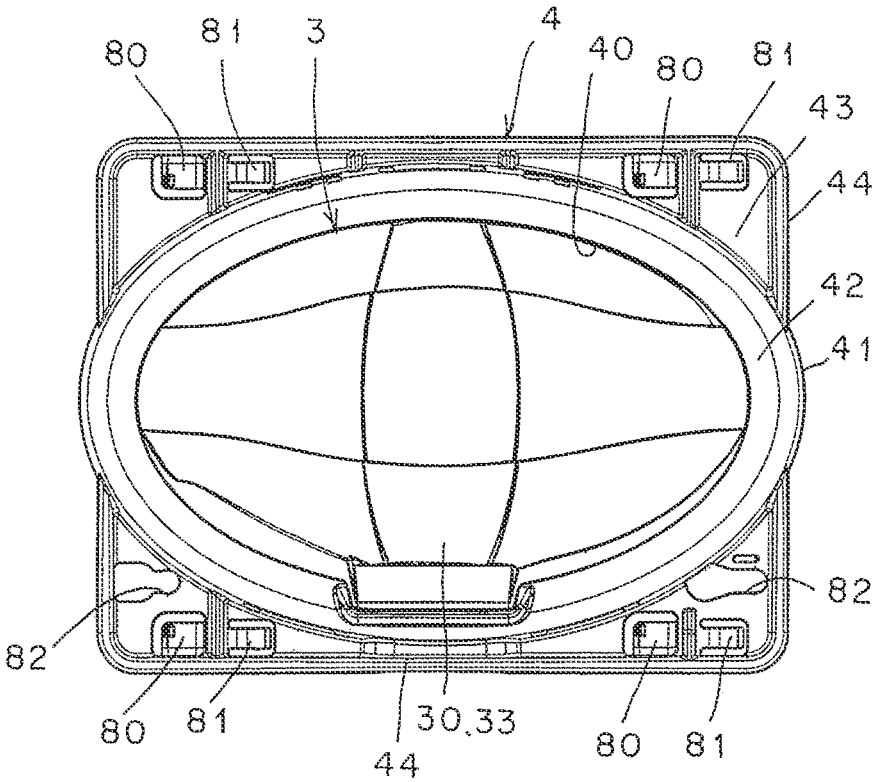
FIG. 6 is a front view showing an assembled state between the lens and the lens holder of the lamp unit.

The gap narrowing section of the lens holder 4, as shown in FIG. 5, is composed of a protrusion 65. The protrusion 65 is provided at a portion on the holding edge part 42 side of the holding cylindrical section 41 of the lens holder 4 and at a respective one of two parts of both of the top left and right sides. At both of the left and right sides of the two protrusions 65, slits (holes or grooves) 66 are respectively provided. As a result, the protrusions 65 each have elasticity thereof in a perpendicular direction or in a substantially perpendicular direction with respect to the Z-axis direction (the Y-axis direction and an opposite direction to the Y-axis direction). The two protrusions 65 are disposed at both of the left and right sides of the pressing section 70 and the positioning surface 71 of the Z-positioning section of the top lens holder 4.

The protrusion section 60 and the contact surface 61 of the XY-positioning section; the protrusion section 62 and the contact surface 63 of the rotation positioning section; and the two receiving surfaces 64 and the protrusion sections 65 of the gap narrowing section are respectively disposed at positions which surround a gravity of the lens 3.

(Attachment Structure)

At the lens holder 4 and the heat sink member 5, attachment structures are respectively provided. The attachment structures reliably attach the lens holder 4 that holds the lens 3, to the heat sink member 5, without using a screw, without any shuddering being generated.

Figure 14:
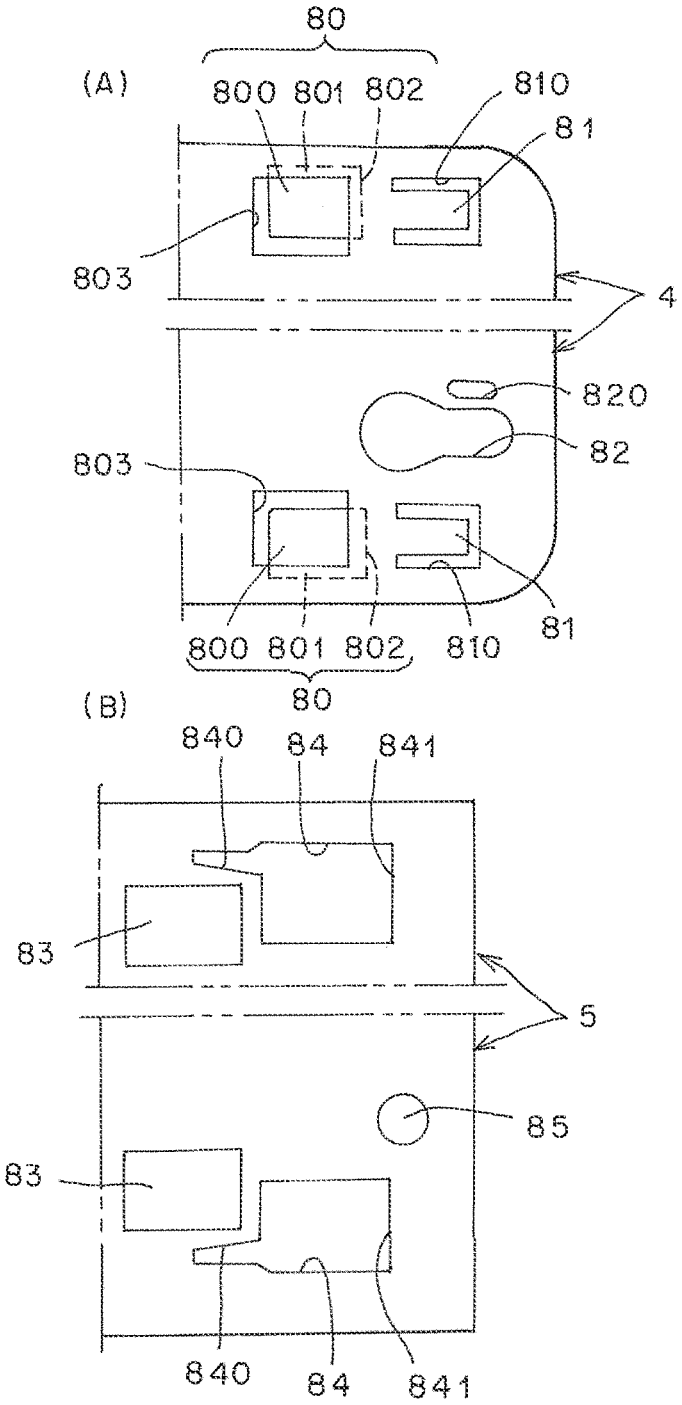
FIG. 14 is an explanatory view showing an attachment hook section and a slip stop section of the lens holder and an attachment section and an insertion space section of the heat sink member.

The attachment structure of the lens holder 4, as shown in FIG. 5 and FIG. 14 (A), is composed of an attachment hook section 80 and a slip stop section 81. The attachment hook section 80 and the slip stop section 81 are respectively are provided at their appropriate positions on one face (a rear face) of the four corners of the mounting plate section 43 of the lens holder 4. The attachment hook section 80 is disposed at an opposite side to the X-axis direction with respect to the slip stop section 81. At two corners of a lower part of the mounting plate section 43 of the lens holder 4, positioning holes 82 are respectively provided. It is to be noted that FIG. 14 (A) is an explanatory view showing the attachment hook section 80 and the slip stop section 81 of the lens holder 4.

The attachment structure of the heat sink member 5, as shown in FIG. 1, FIG. 9, FIG. 11, and FIG. 14 (B), is composed of a surface attachment section 83 and a back face attachment section 830 as attachment sections each having an attachment hole section 84 as an insertion space section. The attachment hole section 84 is provided to correspond to a respective one of the attachment hook section 80 and the slip stop section 81 at a respective one of the four corners of the vertical plate section 52 of the heat sink member 5. The surface attachment section 83 and the back face attachment section 830 are respectively provided to correspond to the attachment hook section 80 on another face (a front face) and one face (a rear face) of an edge part in an opposite direction to the X-axis direction of the attachment hole section 84. At a respective one of two corners of a lower part of the vertical plate section 52 of the heat sink member 5, a positioning pin 85 is provided to correspond to the positioning hole 82. It is to be noted that FIG. 14 (B) is an explanatory view showing the surface attachment section 83 and the attachment hole section 84 of the heat sink member 5.

Figure 10:
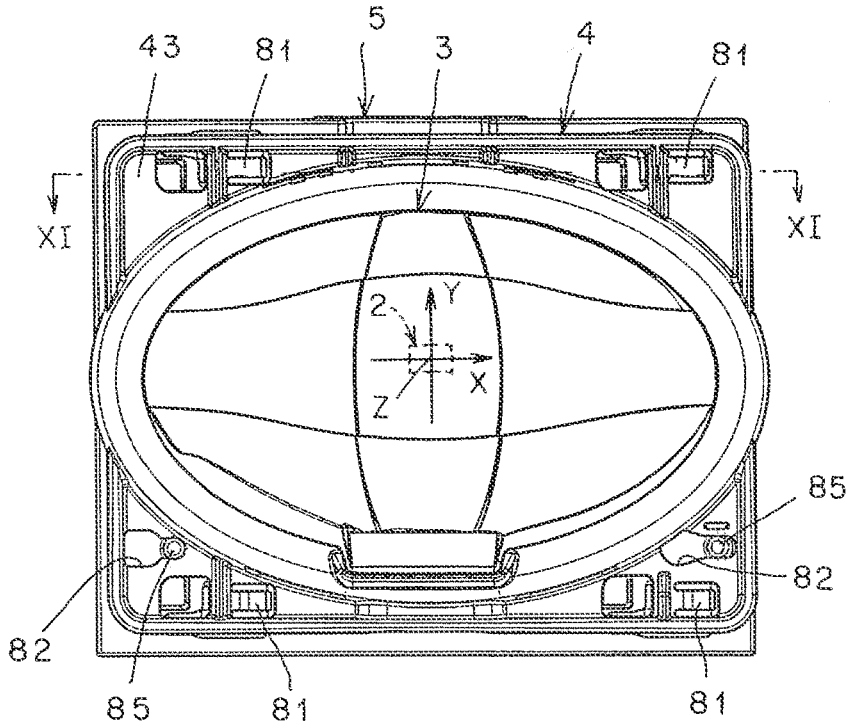
FIG. 10 is a front view showing a state in which the lens and the lens holder are attached to the heat sink.
Figure 13:
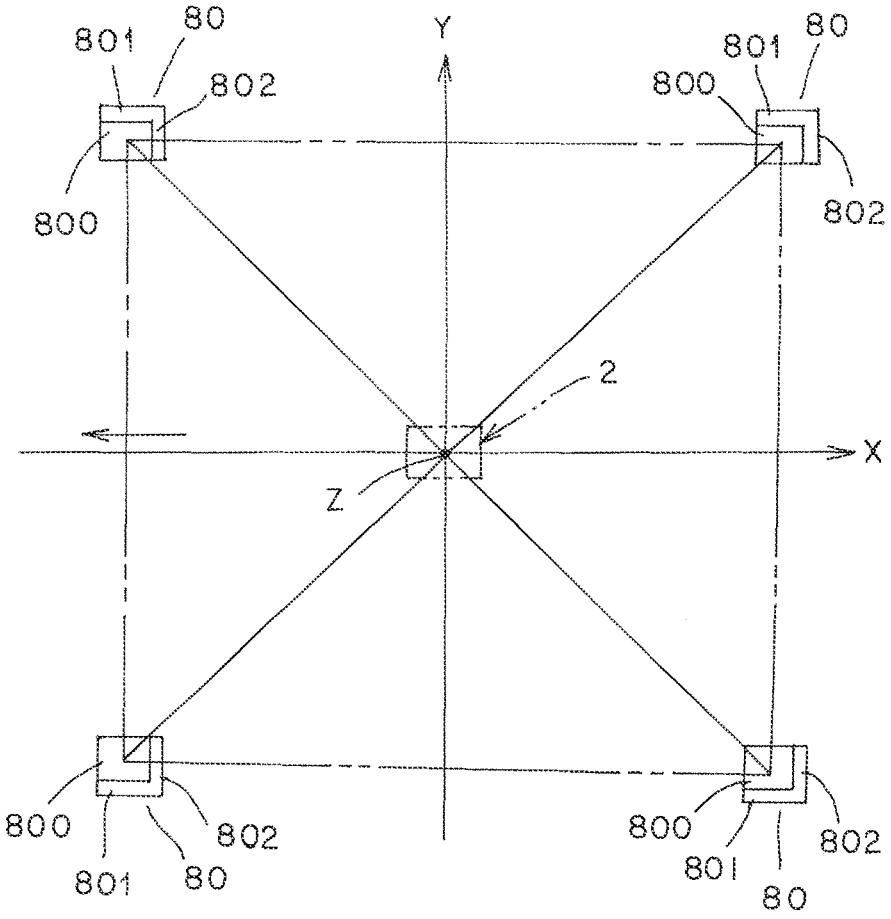
FIG. 13 is an explanatory view showing a relative position relationship between an attachment structure (an attachment hook section) and a light source (the view as indicate by the line XIII-XIII in FIG. 12).

The attachment structures, as shown in FIG. 1, FIG. 2, FIG. 5 to FIG. 8, FIG. 10, and FIG. 13, are provided in four sets in this example. As shown in FIG. 1, FIG. 10, and FIG. 13, in a front view, the semiconductor-type light source 2 is positioned inside of the four sets of the attachment structures (that is, inside of a rectangle connecting the four sets of the attachment structures to each other). In a front view, distances between the respective attachment structures and the semiconductor-type light source 2 are substantially equal to each other. The respective attachment structures are on a same plane or on a substantially same plane which are orthogonal to or substantially orthogonal to the reference optical axis Z of the lens 3 (on a surface of the mounting plate section 43 or a surface of the vertical plate section 52).

(Attachment Hook Section 80)

The attachment hook section 80 is inserted into the attachment hole section 84 in an opposite direction to the Z-axis direction and then is moved in a direction crossing the insertion direction, that is, in an opposite direction to the X-axis direction, to thereby attach the lens holder 4 to the heat sink member 5. That is, the attachment hook section 80, between the mounting plate sections 43 of the lens holder 4, interposes the surface attachment section 83 and the back face attachment section 830 from both sides, that is, in the insertion direction (the opposite direction to the Z-axis direction) and in an opposite direction to the insertion direction (the Z-axis direction) to thereby attach the lens holder 4 to the heat sink member 5. The movement direction (the opposite direction to the X-axis direction and refer to the solid arrow in FIG. 13) is a direction crossing a gravitational direction (an opposite direction to the Y-axis direction).

The attachment hook section 80, as shown in FIG. 13, is provided by two in a direction crossing the movement direction (the Y-axis direction and the opposite direction to the Y-axis direction). The attachment hook section 80 is composed of a rising plate section 802, an interposing plate section 800, and a reinforcement plate section 801. In a close vicinity of the attachment hook section 80, an opening section 803 for die-molding the rising plate section 802, the interposing plate section 800, and the reinforcement plate section 801 are provided.

The rising plate section 802 rises in the insertion direction from an edge at the X-axis direction side of the opening section 803, and is integrally provided at the mounting plate section 43 of the lens holder 4.

The interposing plate section 800 is an interposing section, and is integrally protruded from the rising plate section 802 in the movement direction. The interposing plate section 800 and the rising plate section 802 each form an L-shape, that is, a hook shape.

Figure 11:
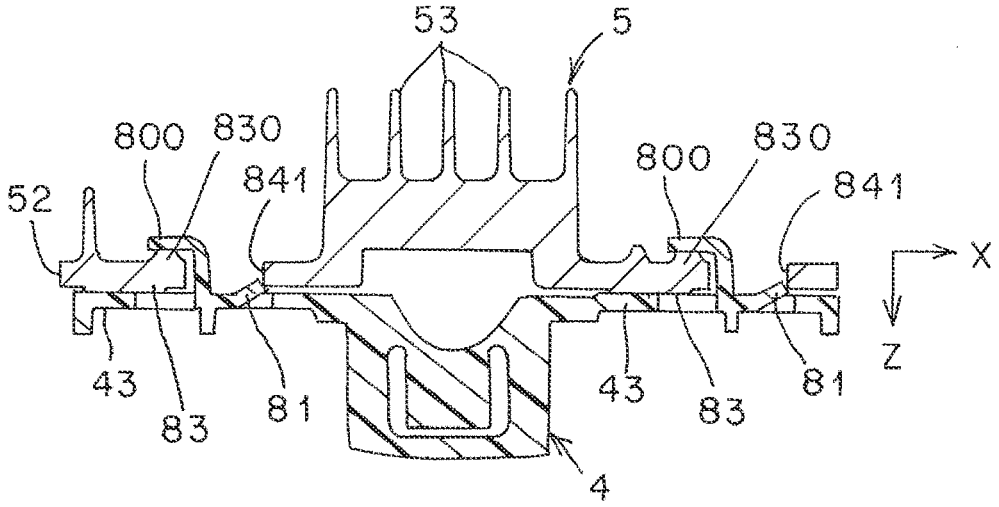
FIG. 11 is a sectional view taken along the line XI-XI in FIG. 10.
Figure 12:
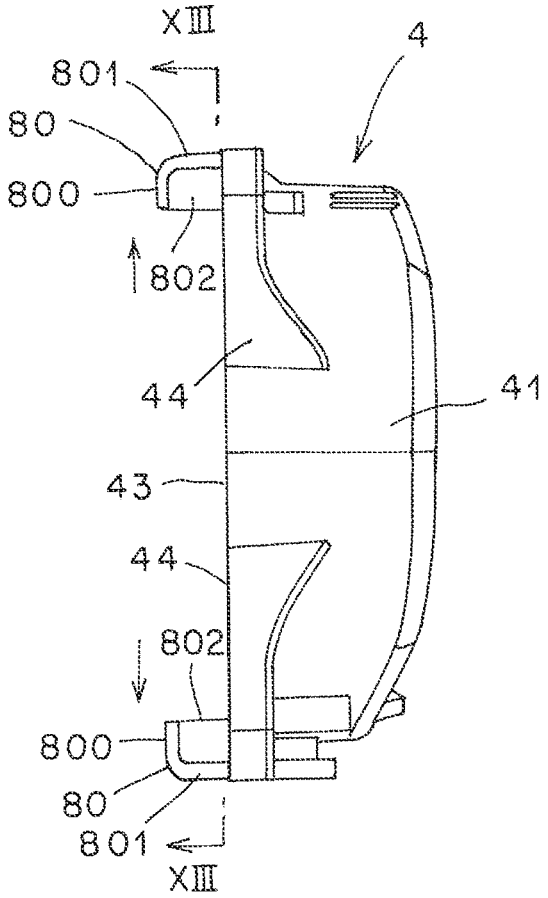
FIG. 12 is a side view showing the lens holder (the view as indicated by the arrow XII in FIG. 2).

The interposing plate section 800 is provided to oppose to an edge of the opening section 803. The interposing plate section 800, as shown in FIG. 11, interposes the surface attachment section 83 and the back face attachment section 830 of the vertical plate section 52 of the heat sink member 5 between the interposing plate section and the edge of the opening section 803.

The reinforcement plate section 801 is one side of a respective one of the rising plate section 802 and the interposing plate section 800, and is integrally provided at one side which is a symmetrical position with respect to the movement direction, in this example, at the outside. That is, the reinforcement plate section 801 at an upper side is provided between an outside edge in the Y-axis direction of the opening section 803 and the interposing plate section 800. The reinforcement plate section 801 at a lower side is provided between an outside edge in the opposite direction to the Y-axis direction of the opening section 803 and the interposing plate section 800.

Figure 16:
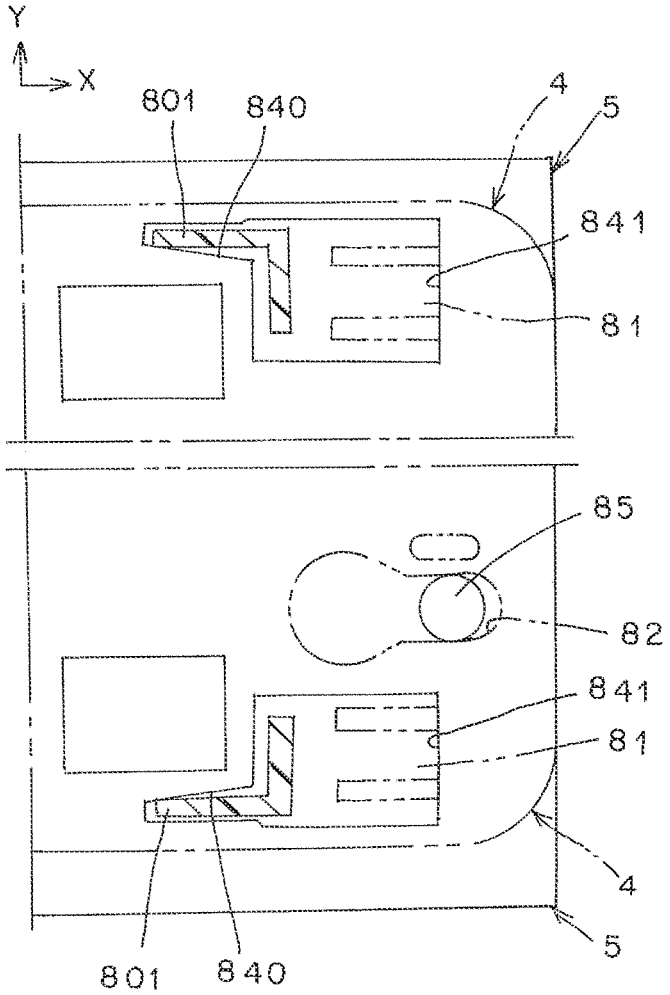
FIG. 16 is an explanatory view showing a state in which the lens holder is attached to the heat sink member.

The reinforcement plate section 801 integrally communicates with the rising plate section 802 in an L-shape. The reinforcement plate section 801 reinforces rigidities of the interposing plate section 800 and the rising plate section 802. The reinforcement plate section 801, as shown in FIG. 16, is guided in the movement direction by way of an edge 840 at the movement direction side of the attachment hole section 84. That is, the reinforcement plate section 801 has a reinforcement function and a guiding function.

(Slip Stop Section 81)

At three sides other than the attachment hook section 80 side of the slip stop section 81, U-shaped cutouts 810 are provided. As a result, the slip stop section 81 has elasticity thereof in the Z-axis direction and the opposite direction to the Z-axis direction. A tip end part of the slip stop section 81 (an end part which is opposite to the attachment hook section 80) forms a lance shape.

The slip stop section 81, as shown in FIG. 11 and FIG. 16, is positioned, and abuts against an edge 841 which is opposite to the edge 840 at the movement direction side of the attachment hole section 84 in a state in which a tip end of the reinforcement plate section 801 is guided to the edge 840 at the movement direction side of the attachment hole section 84. In this manner, the slip stop section 81 and the edge 841 that is opposite to the edge 840 at the movement direction side of the attachment hole section 84 restrain the lens holder 4 from moving (sliding) in the X-axis direction with respect to the heat sink member 5. That is, the slip stop section 81 and the edge 841 that is opposite to the edge 840 at the movement direction side of the attachment hole section 84 stops the attachment hook section 80 from slipping out from the surface attachment section 83 and the back face attachment section 830.

(Mounting Hole Section 84)

The attachment hole section 84, as shown in FIG. 9, FIG. 11, and FIG. 14 to FIG. 16, is composed of: a rectangular hole section through which the attachment hook section 80 can be inserted; and a slit section which is provided in the opposite direction to the X-axis direction from the hole section. In the slit section, the edge 840 at the movement direction side, to which the reinforcement plate section 801 is to be guided, is provided to be inclined. In the hole section, the opposite edge 841 is provided.

The reinforcement plate section 801 and the edge 840 at the movement direction side are provided at least by two in a direction crossing the insertion direction and the movement direction, that is, in the Y-axis direction and the opposite direction to the Y-axis direction. In this example, two of which are provided on the top and bottom of the left side part of a respective one of the lens holder 4 and the heat sink member 5 and the remaining two of which are provided on the top and bottom of the right side part thereof.

(Positioning Hole 82 and Positioning Pin 85)

Figure 15:
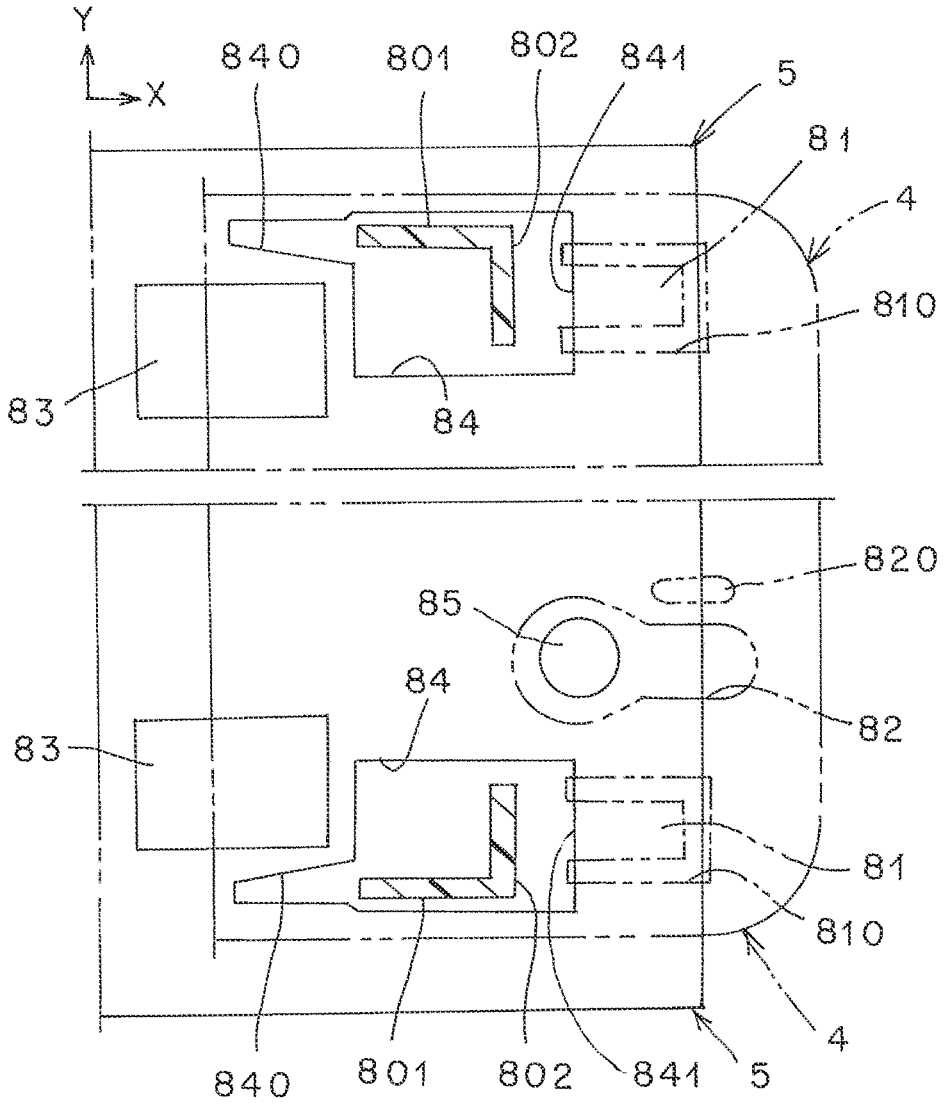
FIG. 15 is an explanatory view showing a state in which the lens holder is attached to the heat sink member.

The positioning hole 82, as shown in FIG. 14 to FIG. 16, has: a large diameter hole which is opposite to the X-axis direction; a small diameter hole at the X-axis direction side; and a communication section by which the large diameter hole and the small diameter hole communicate with each other. A part of the communication section has an interval that is substantially equal to a diameter of the small diameter hole. A diameter of the positioning pin 85 is smaller than a diameter of the large diameter hole and is slightly larger than the diameter of the small diameter hole.

At the mounting plate section 43 of the lens holder 4 and at an edge of one side of the communication section of the positioning hole 82, an elongated hole 820 is provided. A portion between the communication section of the positioning hole 82 and the elongated hole 820 constitutes an elastic section 822 having elasticity thereof in the Y-axis direction and the opposite direction to the Y-axis direction. Both end parts of the elastic section 822 each are connected to the mounting plate section 43 of the lens holder 4 via a connection section 821. That is, the elastic section 822 forms a doubly-supported beam structure by way of the connection sections 821 at both end parts.

(Attachment Method)

The lamp 1 for vehicles, according to the embodiment, is made of the constituent elements as described above, and hereinafter, a description of assembling will be given.

First, the semiconductor-type light source 2 is set to the light source mounting section 50 of the heat sink member 5. Also, the light source holder 21 is attached to the light source holder attachment section 51 of the heat sink member 5 by way of the screw 22. As a result, the semiconductor-type light source 2 is attached to the heat sink member 5 via the light source holder 21.

Next, the emission surface 33 of the lens 3 is positioned at a front side, and the holding edge part 42 of the lens holder 4 is positioned at a front side. This lens 3 is inserted into the holding cylindrical section 41 of the lens holder 4 in the Z-axis direction. Then, the receiving-protrusion section 72 and the positioning protrusion section 73 of the Z-positioning section at the lens 3 side are interposed between the pressing section 70 and the positioning surface 71 of the Z-positioning section at the lens holder 4 side, and are fixed in the Z-axis direction by way of the pressing force of the pressing section 70. As a result, the lens 3 is fixed and held at the lens holder 4 in the Z-axis direction and the opposite direction to the Z-axis direction in a state in which positions in the Z-axis direction and the opposite direction to the Z-axis direction are determined.

In this state, as shown in FIG. 7, the contact surface 61 of the XY-positioning section at the lens 3 side comes into contact with two portions on a side face of the protrusion section 60 of the XY-positioning section at the lens holder 4 side. In addition, similarly, as shown in FIG. 7, the contact surface 63 of the rotation positioning section at the lens 3 side comes into contact with one portion on a side face of the protrusion section 62 of the rotation positioning section at the lens holder 4 side. Further, similarly, as shown in FIG. 7, the protrusion 65 of the gap narrowing section at the lens holder 4 side comes into elastic contact with the receiving surface 64 of the gap narrowing section at the lens 3 side in a perpendicular direction or a substantially perpendicular direction with respect to the Z-axis (the opposite direction to the Y-axis direction). As a result, the lens 3 is fixed and held at the lens holder 4 in each direction in a state in which positions are respectively determined in the X-axis direction and the opposite direction to the X-axis, in the Y-axis direction and the opposite direction to the Y-axis direction, and in the rotation direction (the clockwise direction and counterclockwise direction on the XY-plane about a center of a curved face section of the protrusion section 60).

Figure 9:
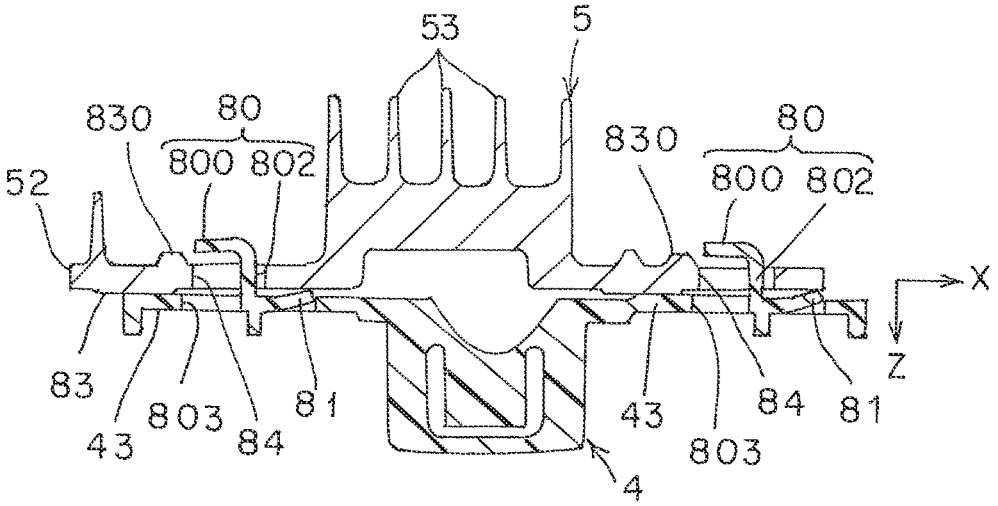
FIG. 9 is a sectional view taken along the line IX-IX in FIG. 8.

Subsequently, as shown in FIG. 9 and FIG. 15, the attachment hook section 80 of the lens holder 4 holding the lens 3 is inserted into the attachment hole section 84 of the heat sink member 5 in the opposite direction to the Z-axis direction. At the same time, the positioning pin 85 of the heat sink member 5 is inserted into the large diameter hole of the positioning hole 82 of the lens holder 4 holding the lens 3 in the opposite direction to the Z-axis direction.

Afterwards, the lens holder 4 holding the lens 3 is moved (slid) in the opposite direction to the X-axis direction with respect to the heat sink member 5. Then, as shown in FIG. 11 and FIG. 16, the surface attachment section 83 and the back face attachment section 830 of the heat sink member 5 are interposed between the interposing plate section 800 of the attachment hook section 80 and the mounting plate section 43 of the lens holder 4. In addition, a corner of a tip end part of the reinforcement plate section 801 of the attachment hook section 80 is guided by an inclined face of the edge 840 at the movement direction side of the attachment hole section 84. Further, the slip stop section 81 is positioned, and abuts against the edge 841 that is opposite to the attachment hole section 84. Thus, it is possible to restrain movement (sliding) of the lens holder 4 in the X-axis direction with respect to the heat sink member 5. Furthermore, the positioning pin 85 elastically abuts against the edge of the communication section of the positioning hole 82.

As a result, the lens holder 4 holding the lens 3 is fixed to the heat sink member 5 in the X-axis direction and the opposite direction to the X-axis direction, in the Y-axis direction and the opposite direction to the Y-axis direction, and in the Z-axis direction and the opposite direction to the Z-axis direction. In this manner, the lamp 1 for vehicles, according to the embodiment, is assembled.

Functions of Embodiment

The lamp 1 for vehicles, according to the embodiment, is made of the constituent elements as described above, and hereinafter, a description of functions thereof will be given.

In the lamp 1 for vehicles, assembled as described above, a light emitting chip of the semiconductor-type light source 2 is lit and light-emitted. Then, a major part of the light that radiated from the light emitting chip is directly made incident into the lens section 30 from the incidence surface 32 of the lens section 30 of the lens 3. At this time, the incident light is controlled to be optically distributed in the incidence surface 32. The incident light having been made incident into the lens section 30 is emitted from the emission surface 33 of the lens section 30. At this time, the emitted light is controlled to be optically distributed in the emission surface 33. The emitted light from the lens section 30 is emitted toward a forward direction of a vehicle, as a predetermined light distribution pattern, for example, a low-beam light distribution pattern or a high-beam light distribution pattern.

In addition, a minor part of the light that is radiated from the light emitting chip is directly made incident into the auxiliary lens section from the incidence surface of the auxiliary lens section of the lens 3. At this time, the incident light is controlled to be optically distributed in the incidence surface. The incident light having been made incident into the auxiliary lens section is reflected on a reflection surface of the auxiliary lens section. At this time, the reflected light is controlled to be optically distributed in the reflection surface.

Further, a heat which is generated in the light emitting chip of the semiconductor-type light source 2 is radiated to the outside via the heat sink member 5.

Advantageous Effect of Embodiment

The lamp 1 for vehicles, according to the embodiment, is made of the constituent elements and functions as described above, and hereinafter, advantageous effect thereof will be described.

The lamp 1 for vehicles, according to the embodiment, interposes the surface attachment section 83 and the back face attachment section 830 of the heat sink member 5 between the mounting plate section 43 of the lens holder 4 and the interposing plate section 800 of the attachment hook section 80 and then attaches the lens holder 4 to the heat sink member 5. Thus, any shuddering which is generated in the opposite direction to the direction in which the surface attachment section 83 and the mounting plate section 43 of the lens holder 4 abut against each other can be eliminated by way of a mutual abutment between the back face attachment section 830 and the interposing plate section 800 of the attachment hook section 80. On the other hand, any shuddering which is generated in the opposite direction to the direction in which the back face attachment section 830 and the interposing plate section 800 of the attachment hook section 80 abut against each other can be eliminated by way of a mutual abutment between the surface attachment section 83 and the mounting plate section 43 of the lens holder 4. Thus, the lens holder 4 can be reliably attached to the heat sink member 5 without any shuddering being generated in the Z-axis direction and the opposite direction to the Z-axis direction without using a screw or the like. Moreover, the positions in the Z-axis direction and the opposite direction to the Z-axis direction can be determined by way of interposing.

In particular, in so far as the lamp 1 for vehicles, according to the embodiment, is concerned, four sets of attachment structures are provided, and in a front view, the semiconductor-type light source 2 is positioned inside of the four sets of attachment structures (that is, inside of a rectangle connecting the four sets of attachment structures to each other). On the other hand, a gravity of the lens 3 is positioned on or near the reference optical axis Z, that is, at or near the semiconductor-type light source 2. Thus, a load that is generated by vibration or impact or the like is dispersed to be substantially equal to the four sets of attachment structures. As a result, the lens holder 4 at which the lens 3 is fixed and held can be held to be stable at the heat sink member 5. That is, the lens 3 can be held to be stable.

Moreover, in so far as the lamp 1 for vehicles, according to the embodiment, is concerned, in a planar view, distances between the respective attachment structures and the semiconductor-type light source 2 are substantially equal to each other. Thus, the load that is generated by the vibration or impact or the like is dispersed to be reliable and substantially equal to the four sets of attachment structures. As a result, the lens 3 can be held to be reliable and stable.

Moreover, in so far as the lamp 1 for vehicles, according to the embodiment, is concerned, the respective attachment structures are on a same plane or on a substantially same plane which is orthogonal to or is substantially orthogonal to the reference optical axis Z of the lens 3 (the face of the mounting plate section 43 and the face of the vertical plate section 52). Thus, the load that is generated by the vibration or impact or the like is dispersed to be further reliable and substantially equal to the four sets of attachment structures. As a result, the lens 3 can be held to be further reliable and stable.

In particular, in so far as the lamp 1 for vehicles, according to the embodiment, is concerned, in the attachment hook section 80, the reinforcement plate section 801 is integrally provided at one side of a respective one of the rising plate section 802 of an L-shape (a hook shape) and the interposing plate section 800. Thus, rigidity of the attachment hook section 80 can be enhanced. As a result, the lens holder 4 at which the lens 3 is fixed and held can be held to be stable at the heat sink member 5. That is, the lens 3 can be held to be stable.

Moreover, in so far as the lamp 1 for vehicles, according to the embodiment, is concerned, the reinforcement plate section 801 is integrally provided at one side of the respective one of the rising plate section 802 and the interposing plate section 800, such one side being at a symmetrical position with respect to the movement direction, in this example, at the outside. Thus, when the load that is generated by the vibration or impact or the like is applied to the four sets of attachment structures and then the attachment hook section 80 elastically deforms (slackens), the resistance forces thereof are cancelled to each other as indicated by the solid arrow in the vertical direction in FIG. 12. As a result, the lens holder 4 at which the lens 3 is fixed and held can be held to be reliable and stable at the heat sink member 5. That is, the lens 3 can be held to be reliable and stable.

Thus, the lamp 1 for vehicles, according to the embodiment, is capable of holding the lens 3 to be stable and thus the position precision of each part is improved. Also, an area of the vertical plate section 52 of the heat sink member 5 (an area in which the mounting plate section 43 of the lens holder 4 at which the lens 3 is fixed and held is to be attached) can be restrained to the minimum. In this manner, weight reduction and inexpensiveness of manufacturing costs can be achieved.

In so far as the lamp 1 for vehicles, according to the embodiment, is concerned, the reinforcement plate section 801 that is provided in the movement direction between the mounting plate section 43 of the lens holder 4 and the interposing plate section 800 is guided by way of the edge 840 at the movement direction side of the attachment hole section 84 of the heat sink member 5. Thus, the movement direction is guided; and therefore, the lens holder 4 can be easily (smoothly) attached to the heat sink member 5 in the movement direction.

In so far as the lamp 1 for vehicles, according to the embodiment, is concerned, in a state in which the reinforcement plate section 801 is guided by way of the edge 840 at the movement direction side of the attachment hole section 84, the slip stop section 81 of the lens holder 4 is positioned, and abuts against the edge 841 that is opposite to the attachment hole section 84 of the heat sink member 5. Thus, it is possible to restrain movement (sliding) of the lens holder 4 in the X-axis direction with respect to the heat sink member 5. That is, the lens holder 4 can be reliably attached to the heat sink member 5 without using a screw or the like without any shuddering being generated in the X-axis direction and opposite direction to the X-axis direction.

In so far as the lamp 1 for vehicles, according to the embodiment, is concerned, the reinforcement plate section 801 and the edge 840 at the movement direction side are provided by a total of four, two of which are provided at the top and bottom of the left side part of a respective one of the lens holder 4 and the heat sink member 5 and two of which are provided at the top and bottom of the right side part, in the direction crossing the insertion direction and the movement direction, that is, in the Y-axis direction and the opposite direction to the Y-axis direction. Thus, two reinforcement plate sections 801 at the top and bottom in the Y-axis direction and the opposite direction to the Y-axis direction are respectively guided by the two edges 840 at the top and bottom at the movement direction side in the Y-axis direction and the opposite direction to the Y-axis direction. As a result, the lens holder 4 can be attached to the heat sink member 5 without using a screw or the like without any shuddering being generated in the Y-axis direction and the opposite direction to the Y-axis direction.

Figure 17:
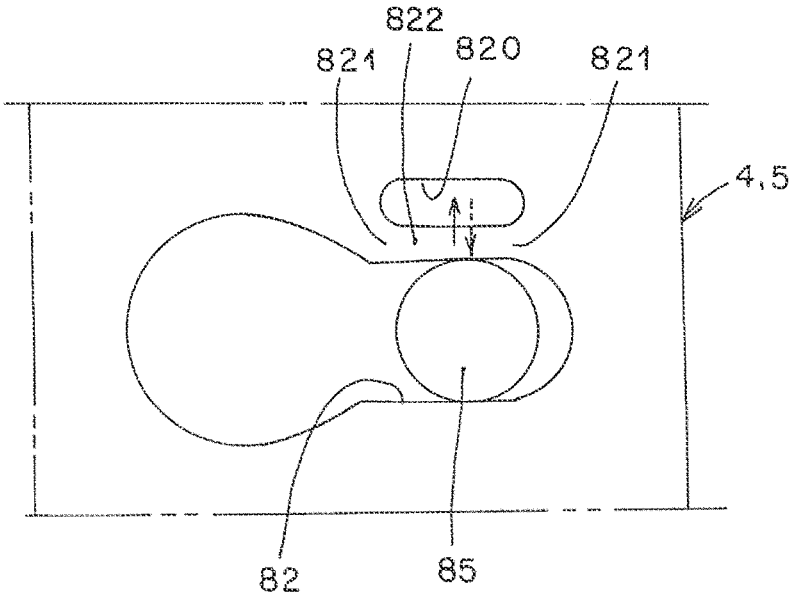
FIG. 17 is a partially enlarged explanatory view showing a positioning hole and a positioning pin.

In particular, in so far as the lamp 1 for vehicles, according to the embodiment, is concerned, the positioning pin 85 of the heat sink member 5 is positioned to cut into the communication section of the positioning hole 82 of the hens holder 4. At this time, as shown in FIG. 17, if the positioning pin 85 that is slightly greater in size than the intervals of the communication section is pressed into the communication section, the elastic section 822 elastically deforms in the Y-axis direction (in the direction indicated by the solid arrow). Thus, the resilient force of the elastic section 822 acts on the positioning pin 85 in the opposite direction to the Y-axis direction (in the direction indicated by the dashed arrow). In this manner, the positioning pin 85 is elastically interposed by way of both side edge parts of the communication section of the positioning hole 82. As a result, the lens holder 4 can be attached to the heat sink member 5 without using a screw or the like without any shuddering being generated in the Y-axis direction and the opposite direction to the Y-axis direction.

The lamp 1 for vehicles, according to the embodiment, moves (slides) and attaches the lens holder 4 to the heat sink member 5 in the opposite direction to the X-axis direction. Thus, the movement direction of the lens holder 4, that is, the opposite direction to the X-axis direction is a gravitational direction, that is, the direction crossing (orthogonal to or substantially orthogonal to) the opposite direction to the Y-axis direction. Thus, the lens holder 4 can be reliably attached to the heat sink member 5 without any shuddering being generated with respect to the vibration or impact in the Y-axis direction and the opposite direction to the Y-axis direction of the vehicle.

The lamp 1 for vehicles, according to the embodiment, in the attachment hook section 80, provides the rising plate section 802 between the edge of the opening section 803 and the interposing plate section 800 or the reinforcement plate section 801, and reinforces rigidities of the interposing plate section 800 and the reinforcement plate section 801. Thus, interposition of the interposing plate section 800 and abutment of the reinforcement plate section 801 can be reliably carried out. In this manner, the lens holder 4 can be reliably attached to the heat sink member 5 without any shuddering being generated.

Modification Example

Figure 18:
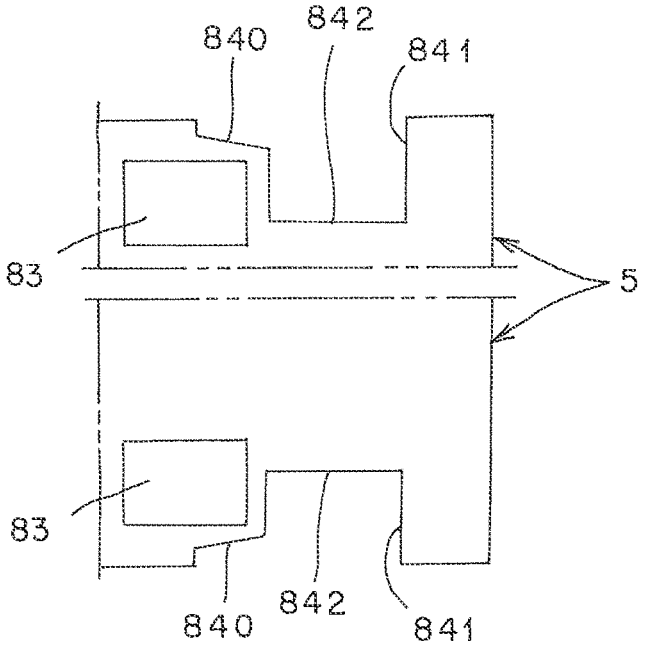
FIG. 18 is an explanatory view showing a modification example of the lamp for vehicles, according to the present invention.

FIG. 18 shows a modification example of the lamp for vehicles, according to the present invention. Hereinafter, the lamp for vehicles, in this modification example, will be described. In the figure, the same reference numerals in FIG. 1 to FIG. 17 designate the same constituent elements.

In so far as the lamp 1 for vehicles, of the foregoing embodiment, is concerned, as shown in FIG. 14 (B), an insertion space section is made of an attachment hole section 84 composed of a rectangular hole section and a slit section. On the other hand, in so far as the lamp for vehicles, of this modification, is concerned, the insertion space section is made of an attachment recessed section 842 which is composed of a rectangular recessed section and a slit-shaped recessed section.

Examples Other than Embodiment and Modification Example

The embodiment and modification example are examples in which a low-beam light distribution pattern and a high-beam light distribution pattern are used in a headlamp for vehicles, such as a headlamp to emit light toward the forward direction of the vehicle. However, in the present invention, these light distribution patterns can also be used in an auxiliary headlamp such as a fog lamp or a lamp for vehicle such as an additional lamp, a tail lamp, a stop lamp, or a tail stop lamp.

In addition, in the embodiment and modification example, the semiconductor-type light source 2 is used as a light source. However, in the present invention, a light source other than the semiconductor-type light source 2 (a light emitting body, a light emitting element, a light emitting member, or a light emitting device) may be used as a light source.

Further, in the embodiment and modification example, the attachment hook section 80 and the slip stop section 81 are provided at the lens holder 4, and the surface attachment section 8, the back face attachment section 830, and the attachment hole section 84 are provided at the heat sink member 5. However, in the present invention, it may be that the surface attachment section 83, the back face attachment section 830, and the attachment hole section 84 are provided at the lens holder 4, and the attachment hook section 80, whereas the attachment hook section 80 and the slip stop section 81 are provided at the heat sink member 5. Also, it may be that the attachment hook section 80, the slip stop section 81, the surface attachment section 83 and the back face attachment section 830, and the attachment hole section 84 are provided at the lens holder 4, whereas the surface attachment section 83 and the back face attachment section 830, the attachment hole section 84, the attachment hook section 80, and the slip stop section 81 are respectively provided so as to correspond to each other.

Furthermore, in the embodiment and modification example, four attachment hook sections 80, four slip stop sections 81, four surface attachment sections 83 and four back face attachment sections 830, and four attachment hole sections 84 are provided. However, in the present invention, the attachment hook section 80, the slip stop section 81, the surface attachment section 83 and the back face attachment section 830, and the attachment hole section 84 may be provided solely or in plurality.

Still furthermore, in the embodiment and modification example, the surface attachment section 83 and the back face attachment section 830 are provided. However, the surface attachment section 83 and the back face attachment section 830 may not be provided.

Yet furthermore, in the embodiment and modification example, the positioning hole 82 and the positioning pin 85 are provided. However, in the present invention, the positioning hole 82 and the positioning pin 85 may not be provided.

Furthermore, in the embodiment and modification example, a uniquely shaped lens 3 which is formed in an elliptical shape in a front view is used. However, in the present invention, a circular lens formed in a front view may be used. In this case, a direction in which the lens holder is moved (slid) to the heat sink member may be a circular direction. Of course, the movement direction may be a longitudinal direction or a transverse direction.

Still furthermore, in the embodiment and modification example, the interposing section and the positioning section of the attachment hook section 80 are respectively composed of the interposing plate section 800 and the reinforcement plate section 801, each of which forms a plate shape. However, in the present invention, the interposing section and the positioning section of the attachment hook section may be composed of anything but the interposing plate section 800 and the reinforcement plate section 801, each of which forms a plate shape.

Yet furthermore, in the embodiment and modification example, four sets of attachment structures are provided; the semiconductor-type light source 2 is positioned inside of the four sets of attachment structures (that is, inside of a rectangle connecting the four sets of attachment structures to each other); and in a planar view, distances between the respective attachment structures and the semiconductor-type light source 2 are substantially equal to each other. However, in the present invention, it may be that: the attachment structures are provided in two sets, three sets, or five sets or more; in a planar view, the semiconductor-type light source 2 is positioned inside of two sets, three sets, and five sets or more of the attachment structures (that is, on the straight line connecting two sets of the attachment structures to each other or inside a triangle or a pentagon or more connecting three sets or five sets of the attachment structures); and in a planar view, distances between the respective attachment structures and the semiconductor-type light source 2 are substantially equal to each other.

Furthermore, in the embodiment and modification example, the reinforcement plate section 801 is integrally provided at one side of a respective one of the rising plate section 802 and the interposing plate section 800, at the outside that is at symmetrical position with respect to the movement direction. However, in the present invention, it may be that the reinforcement plate section 801 is integrally provided at one side of the respective one of the rising plate section 802 and the interposing plate section 800, at the inside that is a symmetrical position with respect to the movement direction, that is, at a respective one of the inside and the outside. In addition, it may be that the reinforcement plate section 801 is integrally provided at one side of the respective one of the rising plate section 802 and the interposing plate section 800, at a nonsymmetrical position with respect to the movement direction, that is, at a respective one of the inside and outside.

DESCRIPTION OF REFERENCE NUMERALS

1 Lamp for vehicles
2 Semiconductor-type light source
20 Board
21 Light source holder
22 Screw
3 Lens
30 Lens section

31 Flange section
32 Incidence surface
33 Emission surface
4 Lens holder
40 Opening section
41 Holding cylindrical section
42 Holding edge section
43 Mounting plate section
44 Reinforcement rib section
5 Heat sink member (attachment member)
50 Light source attachment section
51 Light source holder attachment section
52 Vertical plate section
53 Fin section
54 Recessed section
60, 62 Protrusion sections
61, 63 Contact surfaces
64 Receiving surface
65 Protrusion
66 Slit
70 Pressing section
71 Positioning surface
72 Receiving-protrusion section
73 Positioning protrusion section
74 Cutout
80 Attachment hook section
800 Interposing plate section
801 Reinforcement plate section
802 Rising plate section
803 Opening section
81 Slip stop section
810 Cutout
82 Positioning hole
820 Elongated hole
821 Connection section
822 Elastic section
83 Surface attachment section
830 Back face attachment section
84 Attachment hole section (insertion space section)
840 Edge at movement direction side
841 Opposite edge
842 Attachment recessed section (insertion space section)
85 Positioning pin
XX-axis
YY-axis
ZZ-axis (reference optical axis of lens)

The invention claimed is:

1. A lamp for vehicles, comprising:
a light source;
an attachment member; and
an attached member, wherein
at the attachment member and the attached member, attachment structures to attach the attached member to the attachment member are respectively provided,
the attachment structures each comprises:
an attachment section which is provided at least at either one of the attachment member and the attached member, and which has an insertion space section; and
an attachment hook section which is provided at least at another one of the attachment member and the attached member to attach the attached member to the attachment member, and which corresponds to the attachment section, the attachment hook section being configured such that, when being inserted in an insertion direction into the insertion space of the corresponding attachment section and then moved in a direction crossing the insertion direction, the attachment hook section and said another one of the attachment member and the attached member at which the attachment hook section is provided, interpose the corresponding attachment section therebetween in the insertion direction and an opposite direction thereof by way of a mutual abutment between the corresponding attachment section and each of the attachment hook section and said another one of the attachment member and the attached member.

2. The lamp for vehicles, according to claim 1, wherein the attachment hook section comprises:
an interposing section which is provided to oppose to at least at said another one of the attachment member and the attached member, and which interposes the attachment section; and
a positioning section which is provided in the movement direction between at least said another one of the attachment member and the attached member and the interposing section, and which abuts against an edge at the movement direction side of the insertion space section and then determines a position in the movement direction.

3. The lamp for vehicles, according to claim 2, wherein, at said another one of the attachment member and the attached member, in a state in which the positioning section abuts against the edge at the movement direction side of the insertion space section, there is provided a slip stop section to abut against an opposite edge to the edge at the movement direction side and then determine an opposite position to the movement direction and then stop the attachment hook section from slipping off from the attachment section.

4. The lamp for vehicles, according to claim 2, wherein the positioning section and the edge at the movement direction side of the insertion space section against which the positioning section abuts are provided at least by two in a direction crossing the insertion direction and the movement direction.

5. The lamp for vehicles, according to claim 4, wherein the movement direction is a direction crossing a gravitational direction.

6. A lamp for vehicles, comprising:
an attachment member to which a light source is attached;
an attached member; and
an attachment structure to attach the attached member to the attachment member,
wherein the attachment structure comprises:
an attachment section which is provided at least at either one of the attachment member and the attached member, and which has an insertion space section; and
an attachment hook section which is provided at least at another one of the attachment member and the attached member to attach the attached member to the attachment member and which corresponds to the attachment section, the attachment hook section being configured such that, when being inserted in an insertion direction into the insertion space section of the corresponding attachment section, and then moved in a direction crossing the insertion direction, the attachment hook section and said another one of the attachment member and the attached member at which the attachment hook section is provided, interpose the corresponding attachment section therebetween in the insertion direction and in an opposite direction thereof by way of a mutual abutment between the corresponding attachment section and each of the attachment hook section and said another one of the attachment member and the attached member, wherein the attachment structure is provided in plurality, wherein, in a front view, the light source is positioned inside of a plurality of the attachment structures, and wherein, in a front view, distances between the respective attachment structures and the light source are substantially equal to each other.

7. The lamp for vehicles, according to claim 6, wherein the attachment hook section is provided at least by one in a direction crossing the movement direction, and comprises:

a rising plate section which is provided to rise in the insertion direction from at least another one of the attachment member and the attached member;

an interposing plate section which is extended from the rising plate section in the movement direction, and which interposes the attachment section between the interposing plate section and at least said another one of the attachment member and the attached member; and a reinforcement plate section which is provided at one side of a respective one of the rising plate section and the interposing plate section, said one side being at a symmetrical position with respect to the movement direction.

8. A lamp for vehicles, comprising:

a light source;

a first member; and a second member, wherein attachment structures to attach the first member to the second member are respectively provided at the first member and the second member, each of the attachment structures comprises:

an attachment section, provided at least at one of the first member and the second member, and having an insertion space section; and an attachment hook section provided at least at another one of the first member and the second member, the attachment hook section configured to attach the first member to the second member, and corresponding to the attachment section, the attachment hook section configured such that, when inserted in an insertion direction into the insertion space of the corresponding attachment section and then moved in a direction crossing the insertion direction, the attachment hook section and said another one of the first member and the second member at which the attachment hook section is provided, interpose the corresponding attachment section therebetween in the insertion direction and an opposite direction thereof by way of a mutual abutment between the corresponding attachment section and each of the attachment hook section and said another one of the first member and the second member.

* * * * *